US011499286B1

(12) United States Patent
Warford et al.

(10) Patent No.: US 11,499,286 B1
(45) Date of Patent: Nov. 15, 2022

(54) PORTABLE FOUNDATION AND ANCHOR

(71) Applicants: Lawrence Eugene Warford, Bonney Lake, WA (US); Nicholas J Vizzare, Tacoma, WA (US)

(72) Inventors: Lawrence Eugene Warford, Bonney Lake, WA (US); Nicholas J Vizzare, Tacoma, WA (US)

( * ) Notice: Subject to any disclaimer, the term of this patent is extended or adjusted under 35 U.S.C. 154(b) by 316 days.

(21) Appl. No.: 16/777,839

(22) Filed: Jan. 30, 2020

(51) Int. Cl.
*E02D 5/80* (2006.01)
*E02D 27/32* (2006.01)

(52) U.S. Cl.
CPC ..... *E02D 5/80* (2013.01); *E02D 27/32* (2013.01); *E02D 2220/00* (2013.01)

(58) Field of Classification Search
CPC ..... E02D 5/80; E02D 27/32; E02D 2220/00; Y01S 108/901; Y01S 52/11; F16M 5/00; F16M 2200/08; E04B 1/34352
See application file for complete search history.

(56) References Cited

U.S. PATENT DOCUMENTS

| | | | | | |
|---|---|---|---|---|---|
| 4,189,125 | A * | 2/1980 | Little | F16M 1/00 | 248/346.02 |
| 4,869,456 | A * | 9/1989 | Jacobs | F16M 5/00 | 248/346.02 |
| 5,503,500 | A * | 4/1996 | Oliver | E04B 1/34352 | 405/230 |
| 7,313,892 | B1 * | 1/2008 | Oliver | E04B 1/34352 | 52/309.1 |
| 2002/0069603 | A1 * | 6/2002 | Zornes | C04B 38/0022 | 52/612 |
| 2007/0158526 | A1 * | 7/2007 | Platt | E04H 12/2261 | 248/188.4 |

FOREIGN PATENT DOCUMENTS

| | | | | |
|---|---|---|---|---|
| GB | 2552579 A * | 1/2018 | ..... | E02D 27/42 |
| WO | WO-2013000022 A1 * | 1/2013 | ..... | E02D 27/42 |

* cited by examiner

*Primary Examiner* — Theodore V Adamos
(74) *Attorney, Agent, or Firm* — Joseph Z. Ellsworth

(57) ABSTRACT

Anchor pads are a portable foundation to support the weight of a portable structure. Anchor pads also anchor to the ground to withstand wind loads or other vertical loads on the portable structure. Anchor pads can be stacked to form larger portable foundations to support more weight or larger structures.

16 Claims, 6 Drawing Sheets

PORTABLE FOUNDATION AND ANCHOR

FIELD OF THE INVENTION

The embodiments of the invention relates to a portable foundation for accessibility ramps, platforms, stairs or canopy systems.

BACKGROUND

A Wheelchair ramp is necessary for a building to meet the provisions of the American Disabilities Act (ADA). Buildings built prior to the ADA may have stairs leading up to the entrance with no provisions for the handicapped. These buildings would need a retrofit wheelchair ramp to comply with the ADA. A wheelchair ramp is larger than stairs and may span uneven surfaces or soil. Portable decking, stairs, and accessibility ramps are required to be both properly supported by a footing foundation so that they are properly supported above the ground surface, and are required to be anchored to the ground surface to ensure portable structures can withstand upward and downward loads without lifting away from their footing foundations.

Usually, installers of portable decking, stairs or ramps have to mix and match different footing foundation materials and designs to fit the ground load requirements at their installation site. Installers would also have to use multiple anchoring methods including straps and anchoring bolts simultaneously to anchor down portable structures.

SUMMARY OF THE INVENTION

The current invention is designed to be used to satisfy all of the limitations of the prior art by meeting all the uplift and downward force requirements in one unit instead of multiple anchoring and ground contact systems. The disclosed is a footing foundation intended to be used with portable decking, stairs accessibility ramps and canopy systems. Other uses for the portable foundation include footings for portable or temporary buildings or, buildings that change use. The portable foundation may also be used under modular buildings with an adapted attachment means. The portable foundation and anchor may be constructed of a lightweight strong composite that can replace most currently used wooden, composite, or concrete footing foundations. Disclosed is a portable footing that may have six strategically positioned bolt holes that are also designed to hold bolts in place for blind fastening. Bolts can be used to attach decking feet to the portable anchor pad, and can also be used to bolt through two portable anchor pads to enable stacking in a manner that can increase the weight distribution and uplift capacity.

The disclosure has multiple options for anchoring to ground surfaces. One anchoring option uses drive pins which may be installed through one of the four cutouts located on a corner of the pad. A second anchoring option may be cross drive anchoring through the pad providing an extremely strong connection to the ground surface.

The disclosed embodiment may be arranged in a number of configurations for anchoring adjacent decking support feet to the ground surface. The disclosure provides weight distribution and anchoring when multiple decking support feet are adjacent to each other.

DETAILED DESCRIPTION

Figure 1:
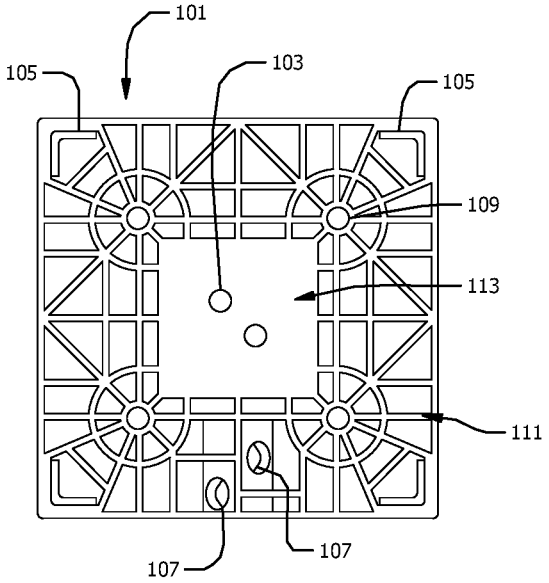
FIG. 1. A top view of an anchor pad.
Figure 1A:
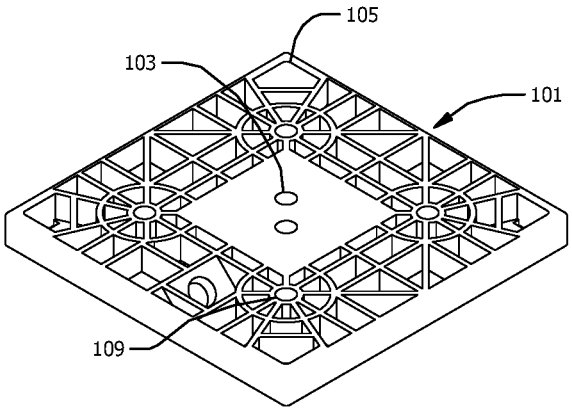
FIG. 1A. A top isometric view of an anchor pad.

The preferred embodiment of the present invention will be described in greater detail. FIG. 1 depicts the anchor pad 101 which provides a footing on soil to distribute the weight of a structure. The structure may be attached to the anchor pad 101 through foot attachment apertures 103. In one example the foot attachment aperture 103 is near the center of the anchor pad 101 slightly offset to allow the foot of the structure being supported to be centered on the anchor pad 101. The anchor pad 101 provides both a reaction to downward weight loads of a structure but also upward wind loads on the structure. The upward wind loads are reacted through a corner stake aperture 105 which is attached to the ground with a stake. In situations where the soil is soft or wind loads are very high additional anchoring may be necessary. Cross drive apertures 107 are a location where stakes may be driven at an angle to the soil surface. The angled stakes function to provide more resistance to upward forces on the anchor pad 101. The angled apertures of the cross drive apertures 107 resist pullout of the stakes through the anchor pad 101 without the stakes having a head.

Outside apertures 109 are placed in a location that allows stacking of multiple anchor pads 101 or to allow attachment to a structure.

The first side outer section 111 may be the upper side of the anchor pad 101. The first side outer section 111 may have ribs and pockets to strengthen and lighten the anchor pad 101. The center section first side 113 is typically the upper side of the anchor pad 101. The center section first side 113 is flat with no pockets to prevent rain or water or debris from collecting under the foot of a structure.

Figure 2:
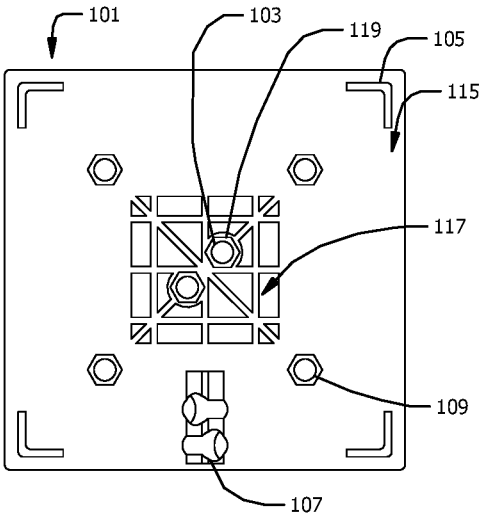
FIG. 2. A bottom view of an anchor pad.
Figure 2A:
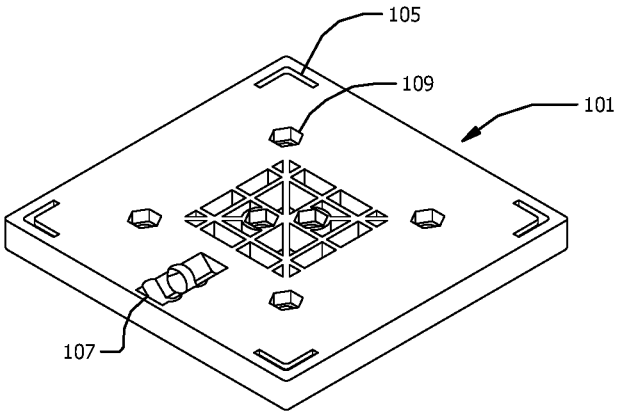
FIG. 2A. A bottom Isometric view of an anchor pad.
Figure 3:
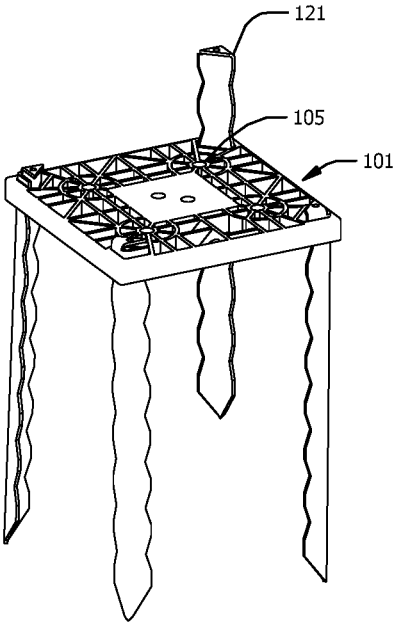
FIG. 3. Shows an example of how an anchor pad would use corner drive pins to anchor to the ground.
Figure 3A:
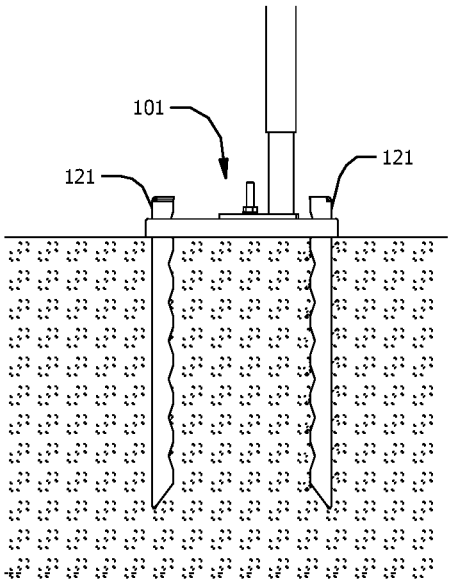
FIG. 3*a*. Shows a side view example anchor pad acting as a footing foundation for a decking platform leg while being anchored to the ground with corner drive pins.
Figure 4:
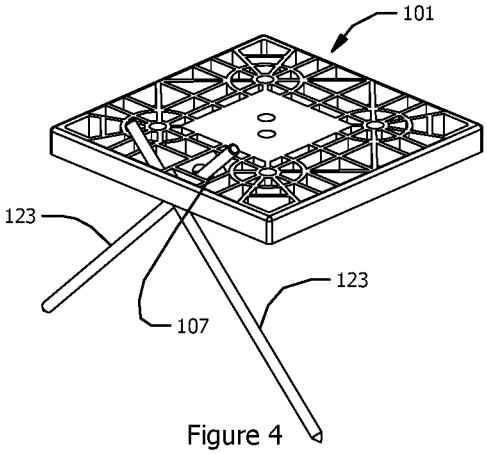
FIG. 4. Shows an example of an anchor pad with the cross drive system to anchor to the ground.
Figure 4A:
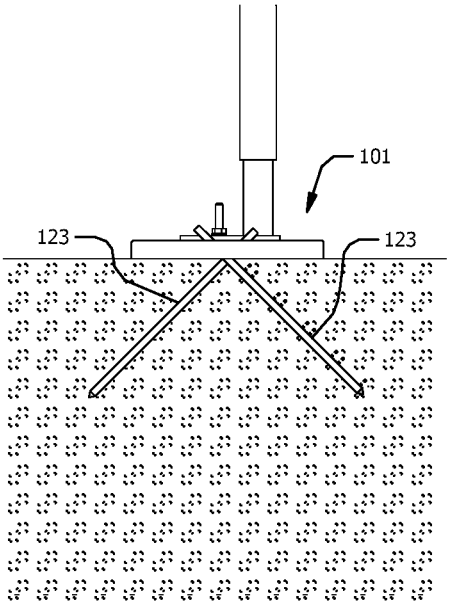
FIG. 4*a*. Shows a side view example of and anchor pad acting as a footing foundation for a decking platform leg while being anchored to the ground with drive pins and the cross drive system.

FIG. 2 shows the second side outer section 115 of the anchor pad 101. The second side outer section 115 may be flat with no pockets to provide a continuous surface for reacting a compression load into soft soil. The center section second side 117 is opposite the center section first side 113. The center section second side 117 may be pocketed and ribbed to reduce weight and maintain structural integrity. The foot attachment apertures 103 may pass through the center section second side 117 and further comprise an anti-rotation feature 119. The anti-rotation feature 119 may further comprise a friction fitting that tightly fits the bolt or is an interference fit of the bolt so the bolt will not fall out during installation. The anti-rotation feature 119 allows a bolt to be tightened from one side or a blind bolt installation. In one example, the anti-rotation feature 119 is hexagonal pocket matching the hexagonal head of a bolt and the pocket allowing the bolt head to sit flush. The second side outer section 115 comprises at least one penetration of an outside aperture 109. The outside aperture 109 may also have an anti-rotation feature 119. The anti-rotation feature 119 may prevent rotation of a bolt or a nut or other fastener.

Figure 5:
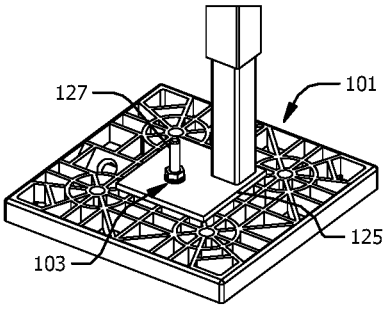
FIG. 5. An isometric view of an anchor pad being used as a footing foundation for a single decking platform support leg.

FIG. 5 shows a single anchor pad 101 connected to a structure foot 125 with a bolt 127. In this example the bolt 127 is inserted on the underside through the foot attachment aperture 103 and through an aperture in the structure foot 125.

Figure 6:
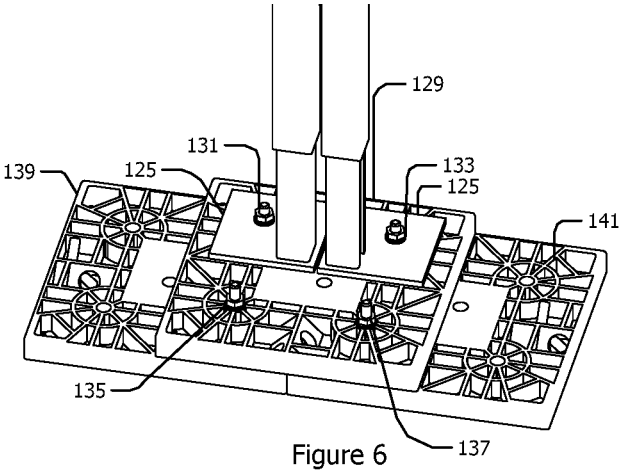
FIG. 6. An isometric view of three anchor pads being stacked together and attached to each other with through bolts so they can be used as a footing foundation for two adjacent decking platform support legs.

FIG. 6 shows a first anchor pad 129 having a first outside aperture 131, second outside aperture 133, third outside aperture 135 and fourth outside aperture 137. In this arrangement the weight of the structure or the softness of the soil requires more footing area under the structure. The first anchor pad is connected to a second anchor pad 139 and a third anchor pad 141. The shape, size and hole locations allow anchor pads to be stacked and connected to form larger portable footings. In the example shown in FIG. 6 the portable footing is a three anchor pad configuration connected to two structure feet. An example of how to connect three anchor pads to double the footing area is to insert a bolt through the second outside aperture 133 of the second anchor pad 139 and the first outside aperture 131 of the first anchor pad 129. A second bolt is inserted through fourth outside aperture 137 of the second anchor pad 139 and through the third outside aperture 135 of the first anchor pad 129. A third bolt is inserted through the first outside aperture 131 in the third anchor pad 141 and through the second outside aperture in the first anchor pad 129. A fourth bolt is inserted through the fourth outside aperture 137 in the third anchor pad 141 and through the fourth outside aperture 137 in the first anchor pad 129. Bolts also go through two structure feet 125.

Figure 7:
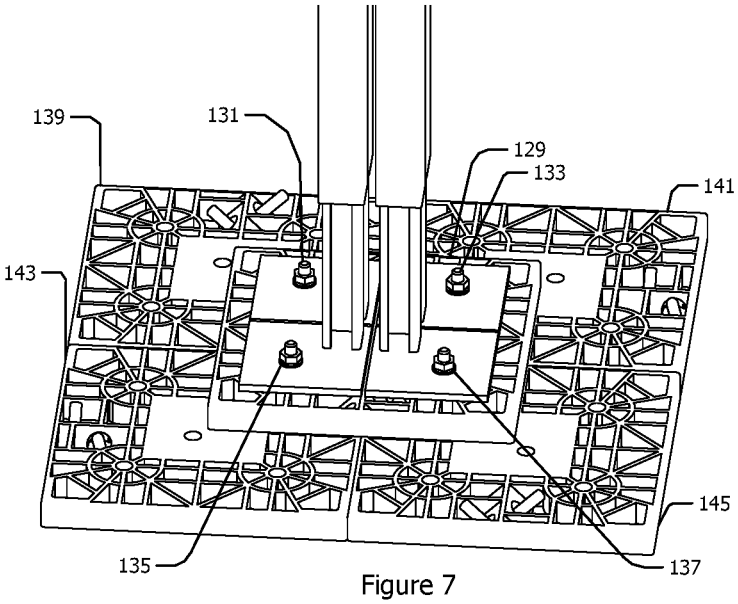
FIG. 7. An isometric view of five anchor pads being stacked together and attached to each other with through bots which can be used as a footing foundation for four adjacent decking platform support legs.

FIG. 7 depicts a five anchor pad combination with 4 structure feet to yield four times footing area. An example of how to connect five anchor pads to quadruple the footing area is to insert a bolt through the fourth outside aperture 137 of the second anchor pad 139 and the first outside aperture 131 of the first anchor pad 129. A second bolt is inserted through second outside aperture 133 of the fourth anchor pad 143 and through the third outside aperture 135 of the first anchor pad 129. A third bolt is inserted through the third outside aperture 135 in the third anchor pad 141 and through the second outside aperture in the first anchor pad 129. A fourth bolt is inserted through the first outside aperture 131 in the fifth anchor pad 145 and through the fourth outside aperture 137 in the first anchor pad 129. Bolts also go through four structure feet 125.

Figure 8:
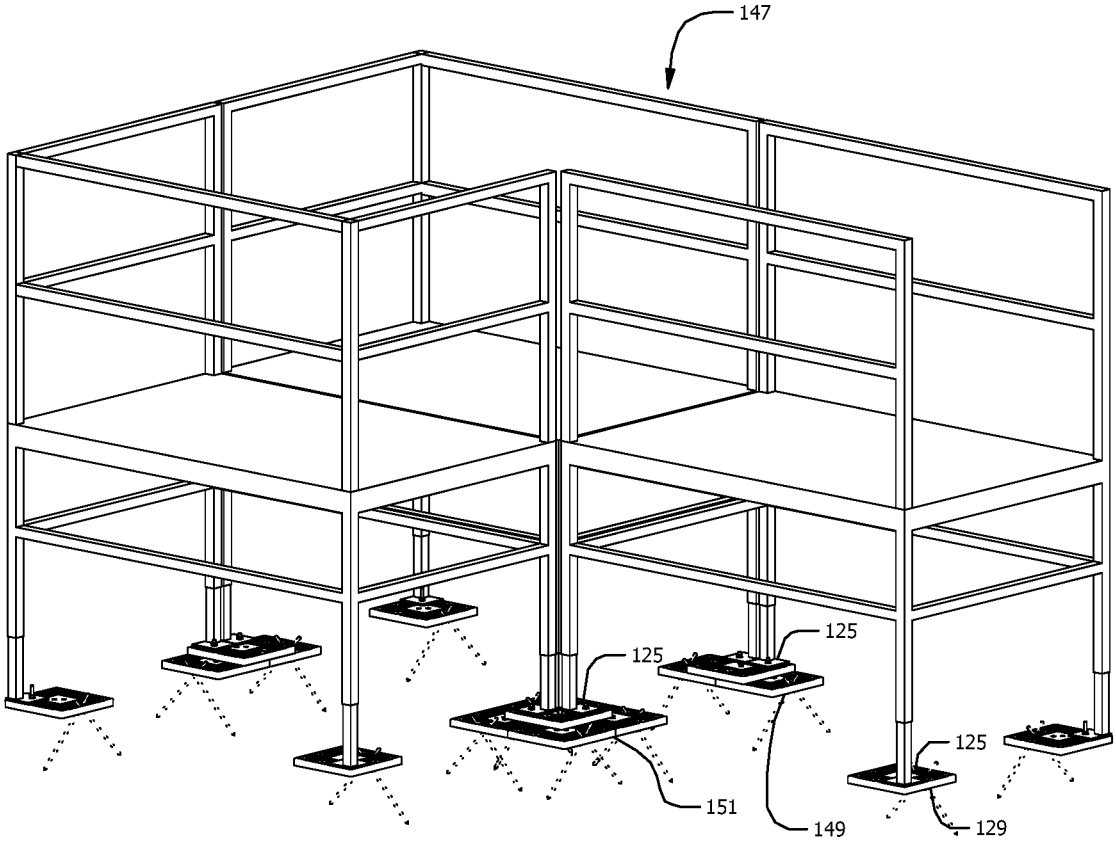
FIG. 8. An isometric view of an example use case for using anchor pads as a footing foundation for all the support legs of three adjacent decking platforms. Three anchor pads are stacked together to support two adjacent support legs. Five anchor pads are stacked together to support three adjacent support legs.

FIG. 8 depicts a platform structure 147 with anchor pads to support the weight and prevent movement from wind. Single structure feet 125 are attached to a first anchor pad 129. Two adjacent structure feet 125 are attached to a triple anchor pad 149. Three adjacent structure feet 125 are attached to a quintuple anchor pad 151. It is noted that four adjacent structure feet 125 may also be attached to a quintuple anchor pad 151.

A method for securing a portable structure comprises, attaching an anchor pad 101 to a portable structure 147 through a foot attachment aperture 103 in the anchor pad 101, and coupling the anchor pad 101 to the ground through an aperture 105, 107 in the anchor pad.

The aperture in the anchor pad 101 can be for example a cross drive aperture 107 where a stake is driven at an angle to the surface of the ground or a corner stake aperture 105 where a stake is driven.

A method of securing the portable structure 147 may further comprise stacking multiple anchor pads 101 to create a foot print larger than a single anchor pad. This may require aligning a plurality of outside apertures 109 to facilitate attachment of the multiple anchor pads 101. As seen in FIG. 6, outside apertures 109 of two lower anchor pads are positioned to allow alignment with an upper anchor pad when the lower anchor pads are placed end to end. As seen in FIG. 7, when four anchor pads are place together at a common corner, to form a square, the outer apertures nearest the common corner may be aligned with a single anchor pad 101 centered on the common corner.

In one example, bolts 127 and nuts are used to fasten the anchor pads 101 together. Rotating a nut of the fastening system passing through the plurality of outside apertures 109 secures the anchor pads. An anti-rotation feature 119 resists rotation of a portion of the fastener system, for example the head of a bolt 127. In one example the anti-rotation feature 119 is a hexagonal pocket configured to match the hexagonal head of a bolt 127.

In one example the anchor pad 101 is a square with 4 quadrants. In the center of each quadrant is an outside aperture 109. Two anchor pads end to end would make eight quadrants each with an outside aperture centered in it. A single anchor pad 101 stacked on the two end to end anchor pads and aligned with the center four quadrants would also align all four outside apertures. Four anchor pads aligned at a corner would form an array of sixteen quadrants. A single anchor pad 101 stacked over the middle four quadrants of the lower four anchor pads would also align the outer apertures 109 because the outer apertures are centered in the quadrants.

In an example, foot attachment apertures 103 are used to attach a single structure foot 125 to an anchor pad. When two three or four structure feet 125 are attached to a single anchor pad the outside apertures 109 are used. The outside apertures 109 align with apertures in the structure feet 125 when the structure feet are end to end or in a two by two array.

Figure 9:
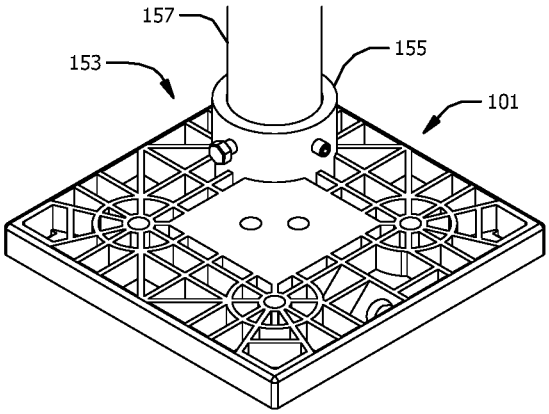
FIG. 9. An Isometric view of an anchor pad with a circular leg attachment feature.

In FIG. 9, an anchor pad 101 further comprises a leg attachment feature 153. The leg attachment feature 153 further comprises a circular receiver 155 to accommodate a circular leg 157. The Circular receiver can accommodate other cross sections of legs such as square or angle iron pieces.

Figure 10:
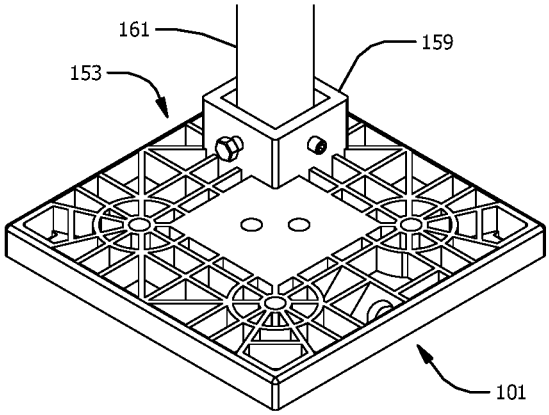
FIG. 10. An Isometric view of an anchor pad with a square leg attachment feature.

In FIG. 10, an anchor pad 101 further comprises a leg attachment feature 153, which further comprises a square receiver 159 for accommodating a square leg 161 from a structure. A square receiver 159 can accommodate circular cross section legs or angle iron legs.

Figure 11:
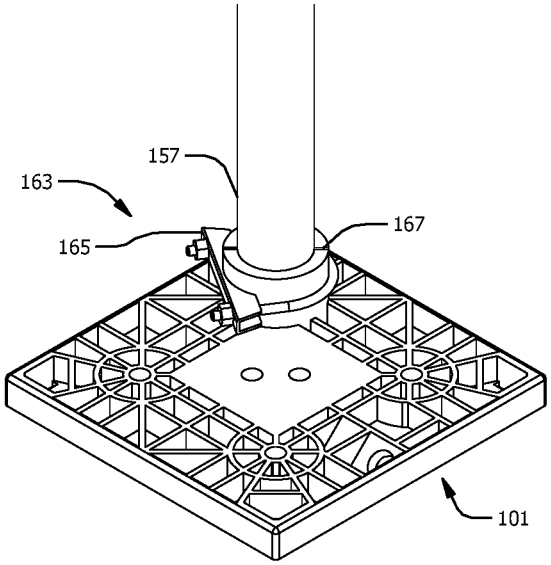
FIG. 11. An Isometric view of an anchor pad with an example slit leg attachment feature.
Figure 12:
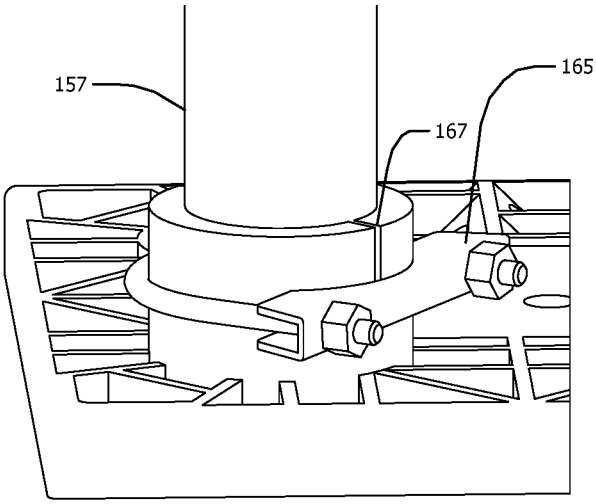
FIG. 12. A Close up cut away view of an example Slit leg attachment and muffler claim.

FIGS. 11 and 12 depict an anchor pad 101 further comprising a slit leg attachment feature 163 having a slit housing 167 that a muffler clamp 165 compresses against a circular leg 157. The slit leg attachment feature 163 is a loose fit and flexes under pressure from the muffler clamp 165 to grip the circular structural leg 157.

Figure 13:
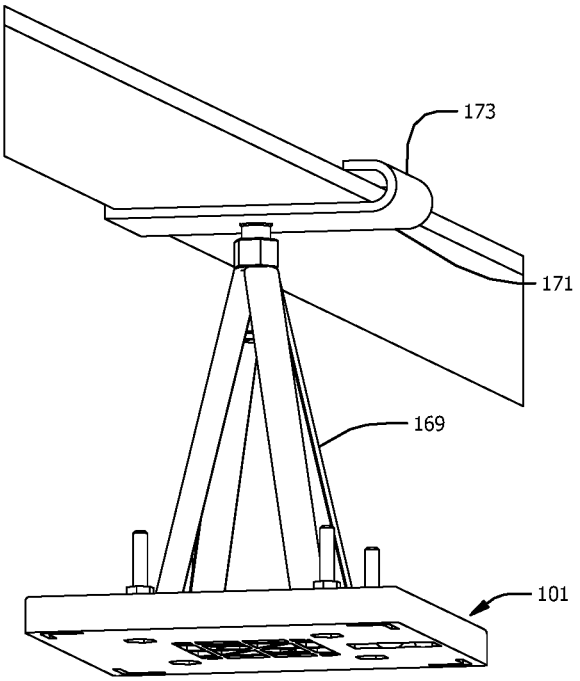
FIG. 13. A Lower isometric view of an anchor pad with an example jack stand attached.
Figure 14:
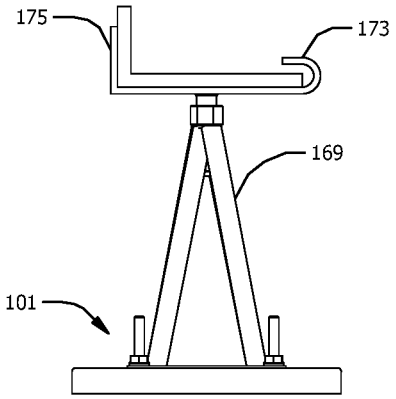
FIG. 14. A Side view of an anchor pad with an example jack stand attached.
Figure 15:
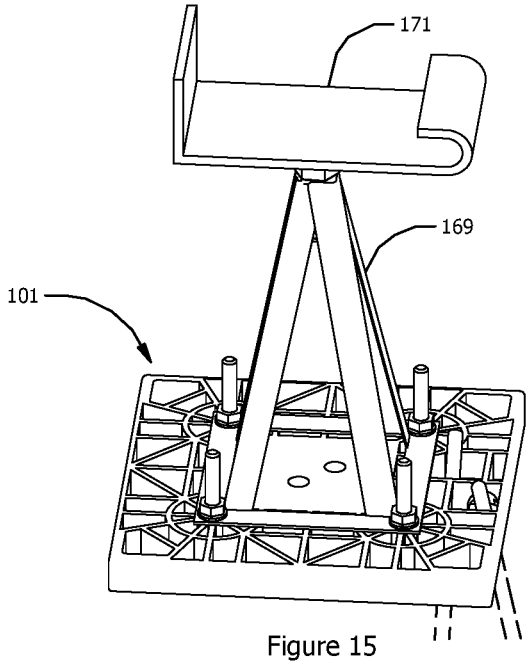
FIG. 15. An Upper isometric view of an anchor pad with an example jack stand attached.

FIG. 13, is an anchor pad 101 with a jackstand 169 attached. The jackstand 169 may be attached through the outside apertures in the anchor pad. The jackstand 169 further comprises a jackstand head 171 configured to support a mobile building frame or other portable structure. The jackstand head may have a lip 173 and a land 175 for clipping a jackstand to a mobile building frame. As shown in FIG. 14, the mobile building frame is inserted into the lip 173 and rotated down adjacent to the land 175 to lock in place. FIG. 15 further depicts the attachment of the jackstand 169 to the anchor plate 101 through the outside apertures.

The anchor pad 101 each may comprise a cross drive system and a corner drive system configured to accept cross drive pins and corner drive pins respectively. In situations where high lift is anticipated, for example with awnings or canopies, both cross drive pins and corner drive pins may be required. In situations where multiple anchor pads are stacked to create a larger foot print (for example, the three anchor pad stack, the four anchor pad stack, or the five anchor pad stack), each lower pad may be anchored with cross drive pins, or corner drive pins, or both.

The invention claimed is:

1. A portable footing comprising:

a first anchor pad configured to react downward weight loads of a structure and upward wind loads on a structure, the first anchor pad comprising:

a center section and an outer section extending around the center section, the center section comprising at least one foot attachment aperture configured to attach to a structures;

a first side and an opposite second side;

the center section at the first side of the first anchor pad being substantially flat and absent pockets;

the center section at the second side of the first anchor pad comprising a plurality of ribs and pockets; and the outer section at the first side of the first anchor pad comprising a plurality of ribs and pockets; and the outer section at the second side of the first anchor pad is substantially flat and absent pockets, and configured to provide a continuous surface for reacting a compression load onto a support surface.

2. The portable footing of claim 1 further comprising, a corner stake aperture configured to be attached to a surface with a stake.

3. The portable footing of claim 1 further comprising, cross drive apertures configured to allow stakes to be driven at an angle to a soil surface.

4. The portable footing of claim 1 further comprising, outside apertures configured to allow stacking of multiple anchor pads or to allow attachment to a structure.

5. The portable footing of claim 1, further comprising, the at least one foot attachment aperture passing through the center section at the second side of the first anchor pad, and further comprising an anti-rotation feature, wherein the anti-rotation feature is configured to allow a bolt to be tightened from one side.

6. The portable footing of claim 5 wherein, the anti-rotation feature is a hexagonal pocket configured to match a hexagonal head of the bolt.

7. The portable footing of claim 1 wherein, the first anchor pad further comprises, a first outside aperture, a second outside aperture, a third outside aperture, and a fourth outside aperture, wherein the outside aperture locations allow a plurality of anchor pads to be connected to form larger portable footings.

8. A portable footing of claim 7 further comprising, the first anchor pad connected to a second anchor pad and a third anchor pad wherein;

the second anchor pad further comprises, a first outside aperture, a second outside aperture, a third outside aperture, and a fourth outside aperture, and the third anchor pad further comprises, a first outside aperture, a second outside aperture, a third outside aperture, and a fourth outside aperture;

a first bolt extending through the second outside aperture of the second anchor pad and the first outside aperture of the first anchor pad, a second bolt extending through the fourth outside aperture of the second anchor pad and through the third outside aperture of the first anchor pad;

a third bolt extending through the first outside aperture in the third anchor pad and through the second outside aperture in the first anchor pad; and a fourth bolt extending through the fourth outside aperture in the third anchor pad and through the fourth outside aperture in the first anchor pad.

9. The portable footing of claim 8 wherein, at least two of the first outside aperture, the second outside aperture, the third outside aperture, and the fourth outside aperture of the first anchor pad are configured to allow a bolt to further extend through a first and second structure foot.

10. The portable footing of claim 7 further comprising, the first anchor pad connected to a second anchor pad, a third anchor pad, a fourth anchor pad and a fifth anchor pad wherein;

the second anchor pad further comprises, a first outside aperture, a second outside aperture, a third outside aperture, and a fourth outside aperture, the third anchor pad further comprises, a first outside aperture, a second outside aperture, a third outside aperture, and a fourth outside aperture, the fourth anchor pad further comprises, a first outside aperture, a second outside aperture, a third outside aperture, and a fourth outside aperture, and the fifth anchor pad further comprises, a first outside aperture, a second outside aperture, a third outside aperture, and a fourth outside aperture;

a first bolt extending through the fourth outside aperture of the second anchor pad and the first outside aperture of the first anchor pad, a second bolt extending through the second outside aperture of the fourth anchor pad and through the third outside aperture of the first anchor pad, a third bolt extends through the third outside aperture in the third anchor pad and through the second outside aperture in the first anchor pad, and a fourth bolt extends through the first outside aperture in the fifth anchor pad and through the fourth outside aperture in the first anchor pad.

11. The portable footing of claim 10 wherein, the first outside aperture, the second outside aperture, the third outside aperture, and the fourth outside aperture are configured to allow bolts to further extend through three or four structure feet.

12. The portable footing of claim 1 further comprising, an outside attachment aperture configured to attach to a foot of a structure.

13. A method for securing a portable structure comprising:

attaching a first anchor pad to a portable structure through a foot attachment aperture in the first anchor pad, and coupling the first anchor pad to a ground through an aperture in the first anchor pad, wherein the first anchor pad comprises a plurality of corners and the aperture in the first anchor pad is a corner stake aperture nested in each corner of the first anchor pad and configured to receive a corner stake having two flanges at a right angle, wherein the first anchor pad further comprises:

a center section and an outer section extending around the center section, the center section comprising the foot attachment aperture;

a first side and an opposite second side;

the center section at the first side of the first anchor pad being substantially flat and absent pockets, the center section at the second side of the first anchor pad comprising a plurality of ribs and pockets; and the outer section at the first side of the first anchor pad comprising a plurality of ribs and pockets, wherein the outer section at the second side of the first anchor pad is substantially flat and absent pockets, and configured to provide a continuous surface for reacting a compression load into the ground.

14. The method for securing the portable structure of claim 13 further comprising, stacking multiple anchor pads to create a foot print larger than a single anchor pad, aligning a plurality of outside apertures to facilitate attachment of the multiple anchor pads.

15. The method for securing the portable structure of claim 14 further comprising, rotating a fastening system passing through the plurality of outside apertures wherein, an anti-rotation feature resists rotation of a portion of the fastener system.

16. The method for securing the portable structure of claim 15 wherein, the anti-rotation feature is a hexagonal pocket configured match a hexagonal head of a bolt.

* * * * *